United States Patent [19]

Röck et al.

[11] 4,294,499

[45] Oct. 13, 1981

[54] PULL-OUT GUIDE ASSEMBLY

[75] Inventors: Erich Röck, Höchst; Bernhard Mages, Dornbirn, both of Austria

[73] Assignee: Julius Blum Gesellschaft m.b.H., Höchst, Austria

[21] Appl. No.: 45,264

[22] Filed: Jun. 4, 1979

[30] Foreign Application Priority Data

Jun. 6, 1978 [AT] Austria ..... 4097/78

[51] Int. Cl.[3] ..... A47B 88/04; A47B 88/14; A47B 88/16

[52] U.S. Cl. ..... 312/334; 312/341 R; 312/348; 308/3.6

[58] Field of Search ..... 312/330 R, 330 SM, 331, 312/341 R, 334, 344, 348; 308/3.6, 3.8

[56] References Cited

U.S. PATENT DOCUMENTS

| | | | |
|---|---|---|---|
| 1,207,942 | 12/1916 | Lehmann | 312/331 |
| 3,649,090 | 3/1972 | Dutot | 308/3.6 |
| 3,722,964 | 3/1973 | Chitester et al. | 312/331 |
| 4,070,076 | 1/1978 | Zwillinger | 308/3.8 |
| 4,121,876 | 10/1978 | Ratti | 312/330 R |

FOREIGN PATENT DOCUMENTS

| | | | |
|---|---|---|---|
| 467046 | 2/1969 | Switzerland | 312/341 R |

OTHER PUBLICATIONS

Offenlegungsschrift, No. 2217853 to Schock, 10/73.

*Primary Examiner*—Alexander Grosz
*Attorney, Agent, or Firm*—Wenderoth, Lind & Ponack

[57] ABSTRACT

A pull-out guide assembly for drawers or the like with which the drawer can be pulled free of a cabinet while it is still held by the guide assembly. The guide assembly has an intermediate rail on each side of the drawer which moves between, and with respect to, the drawer and the cabinet. The movement is steered by a belt forming a closed loop. The belt is carried on the intermediate rail and is connected both with the drawer and the cabinet.

9 Claims, 4 Drawing Figures

PULL-OUT GUIDE ASSEMBLY

BACKGROUND OF THE INVENTION

1. Field of the Invention

The invention relates to a pull-out guide for drawers comprising one rail movably mounted on either side of the drawer between holding means disposed on the side of the body and on the side of the drawer, the rail making a relative movement with respect to the body as well as with respect to the drawer, when the drawer is pulled out or pushed in.

2. Description of the Prior Art

Such pull-out guides are widely used in modern furniture production, particularly in the production of kitchen and office furniture. It is their task to facilitate the movement of the drawer. Moreover, it is their task to hold the drawer in the body and prevent the drawer from tilting over in the pulled-out position.

In order to give free access to the objects in the drawer it should be possible to pull the drawer fully or almost fully free of the body.

SUMMARY OF THE INVENTION

It is the object of the present invention to provide a pull-out guide of the above-mentioned type in which the movement in the rail, being a so-called intermediate rail, is uniform and controlled.

The rail should move exactly half the path of the drawer, when the drawer is pulled out of the body of the piece of furniture or is pushed thereinto.

According to the invention this is achieved by providing an endless belt mounted on the rail, preferably on its front and rear ends, the belt being connected on opposite sides with the body and the drawer by means of respective holding devices thereof, the upper run of the belt, for example, being connected with the drawer and the lower run with the body.

In order to facilitate the movement of the belt, the belt is preferably mounted on two rollers disposed on or near opposite ends of the rail.

One embodiment of the invention provides that the holding means are slides positively engaging the rail. The rail has, for example, a U-shaped profile, and the slides are provided with recesses of L-shaped cross-sections, one horizontal flange and part of the vertical flange of the rail projecting into each such recess. Thereby a particularly secure mounting of the rail is obtained.

A further embodiment of the invention provides that the belt is linked to the holding devices of the body and of the drawer by means of pins, clamps or the like.

Such pins or clamps are preferably welded to the belt.

A further embodiment provides that holding devices are disposed on the front side and in the center of the body wall and on the rear side and in the center of the side-wall of the drawer.

Thus an absolutely secure mounting of the drawer is obtained by the holding devices, which are of simple construction.

BRIEF DESCRIPTION OF THE DRAWINGS

In the following an embodiment of the invention will be described in more detail, with reference to the accompanying drawings without being limited thereto, and wherein:

FIG. 1 is a schematic side view of a drawer with a pull-out guide in accordance with the present invention, when the drawer is pushed in;

DESCRIPTION OF THE PREFERRED EMBODIMENT

Figure 1:
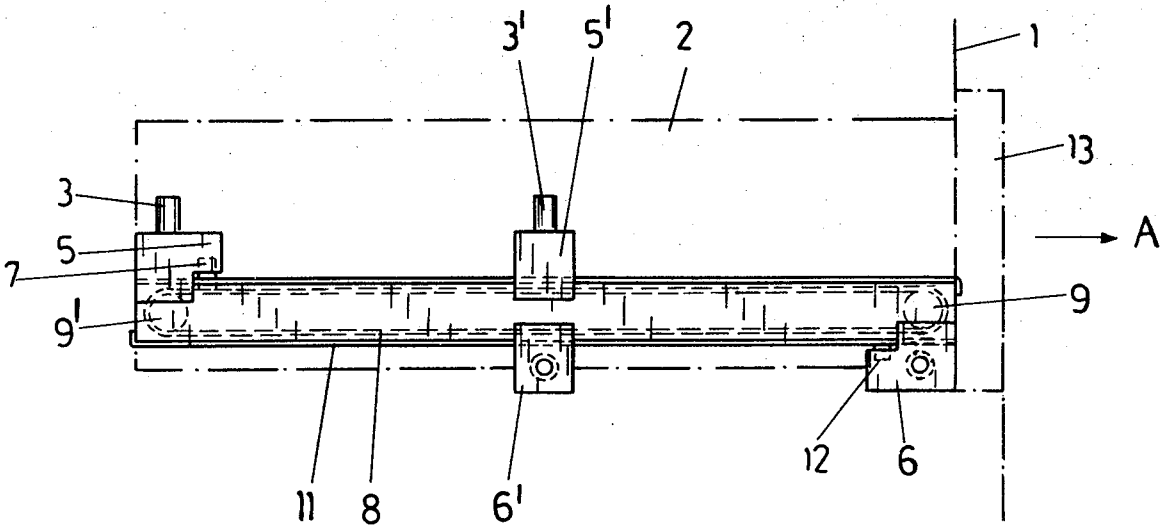
Figure 2:
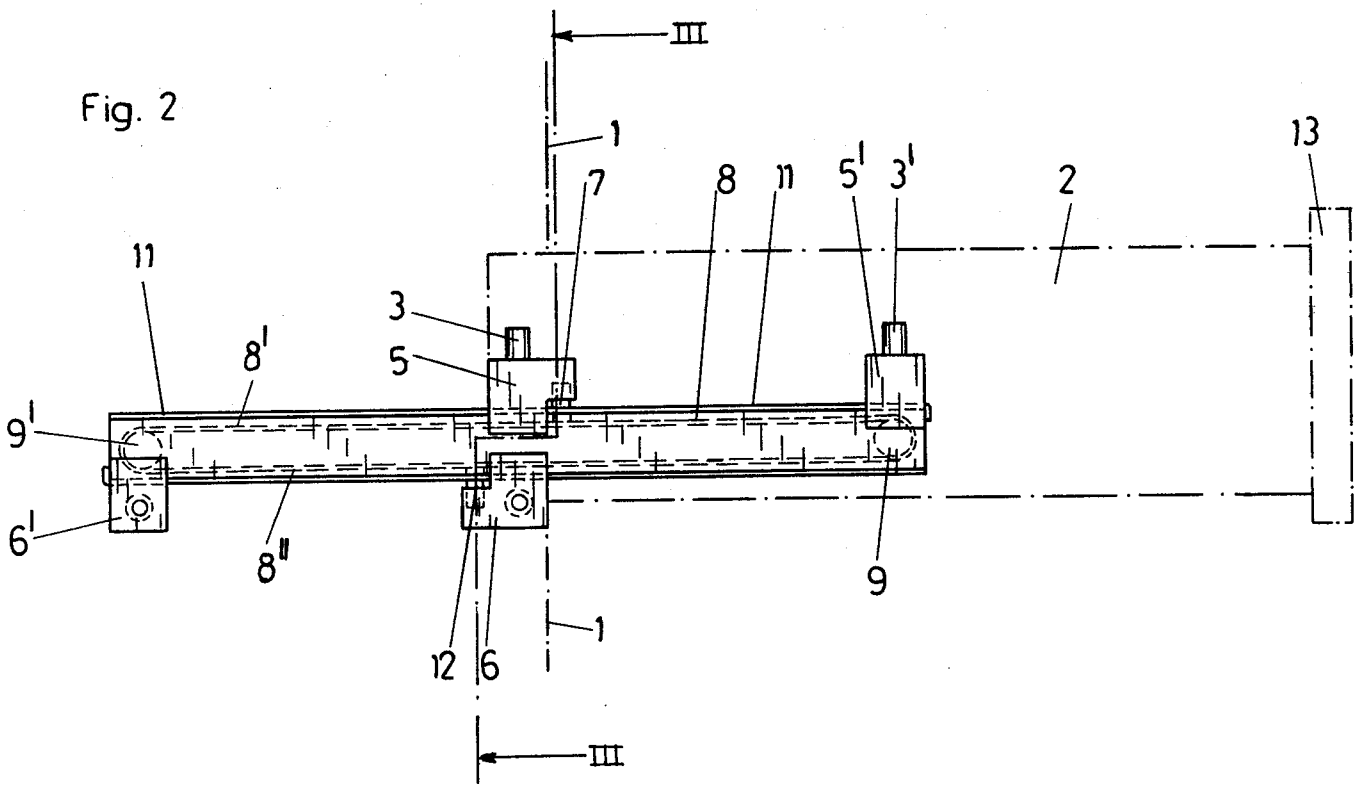
FIG. 2 is a view similar to FIG. 1, the drawer being pulled out of the body of the piece of furniture.
Figure 3:
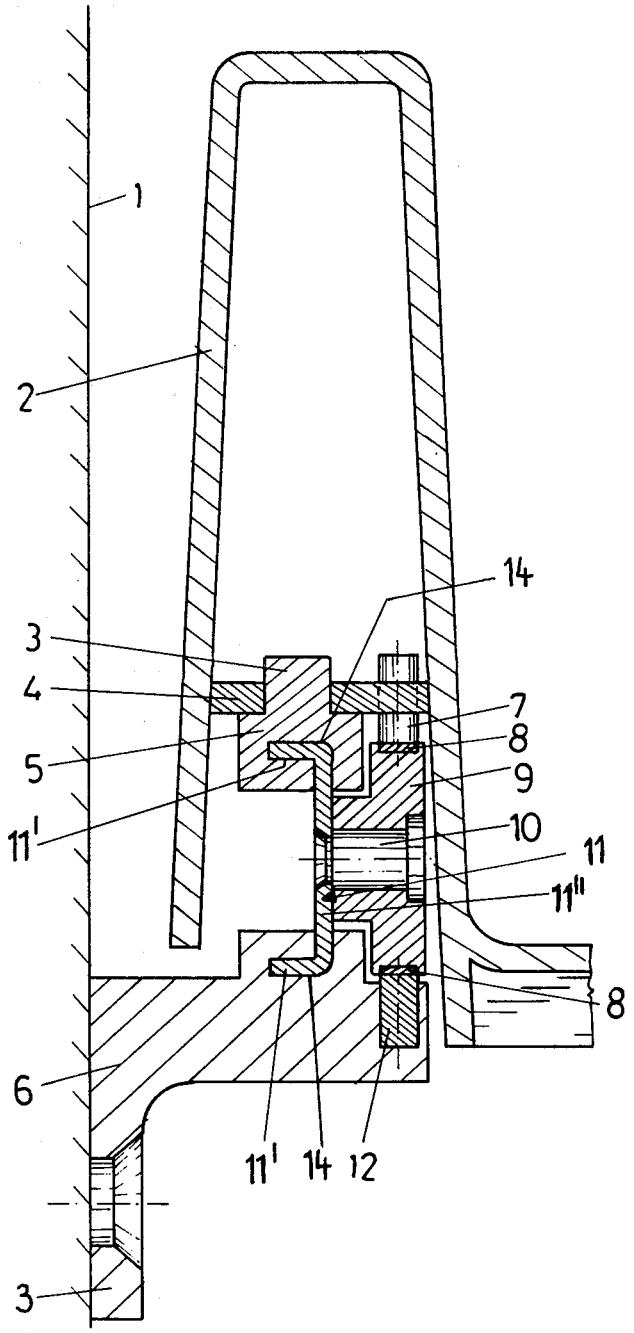
FIG. 3 is a sectional view along line III—III of FIG. 2.
Figure 4:
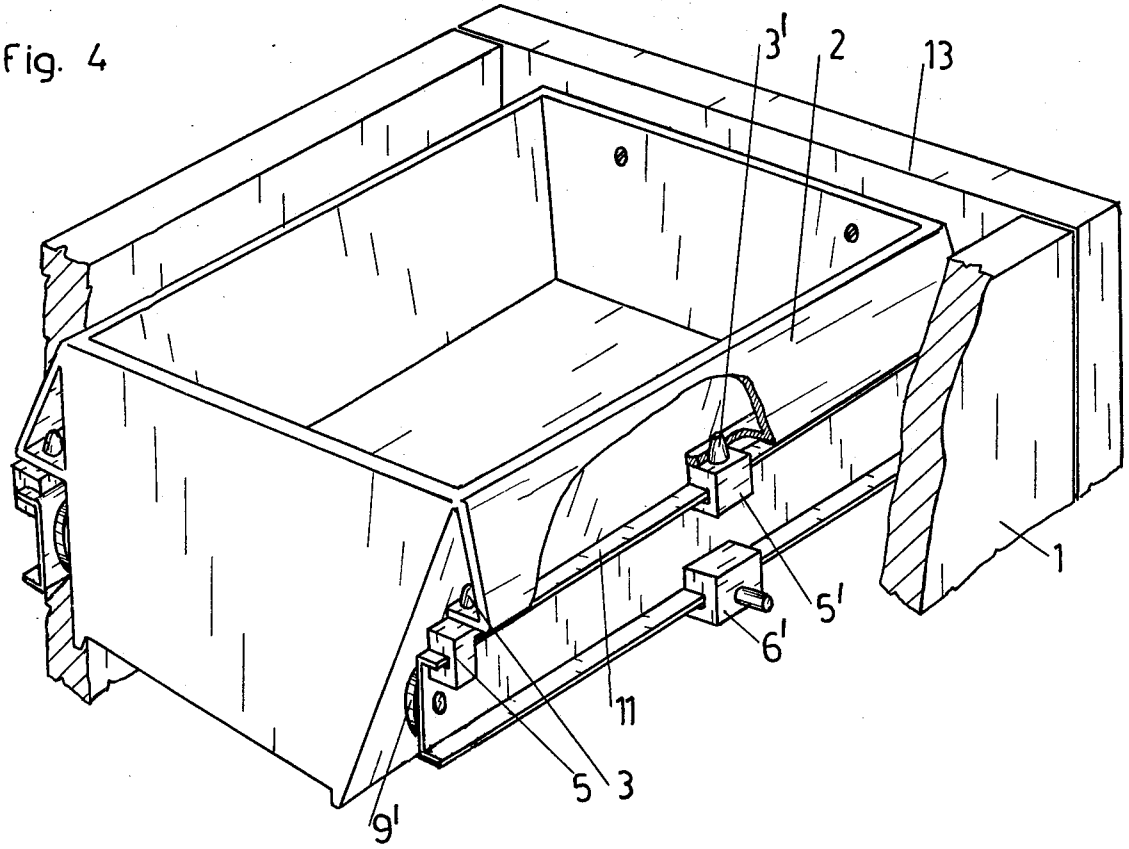
FIG. 4 is a perspective view, partially broken away, of a drawer with a pull-out guide.

As can be seen in FIGS. 1 and 2, the rear end of the drawer 2 is provided on each side thereof with a holding or supporting device in the form of a slide or support 5. A slide 5' is disposed in the center or almost in the center of the drawer. The body 1 of the side-wall of the piece of furniture also carries slides 6 and 6', one slide 6 being disposed on the front side of the body and the other slide 6' approximately in the center of the piece of furniture at a position correspondingly to the center of the drawer 2 when the drawer is pushed in.

A rail 11 is pushed into the slides 5, 5', 6, 6', the slides 5, 5', 6, 6' having L-shaped recesses 14, each of which receives a horizontal flange 11' and part of a vertical flange 11'' of the rail 11.

The slides 5, 5' and 6, 6' can be fixed to the drawer 2 and to the body 1 of the piece of furniture, respectively, either by means of fastening pins or rods 3, 3' or by being directly screwed thereto.

Rollers 9, 9' are provided on opposite ends of the rail 11, each roller being mounted on an axle 10. Each axle 10 is mounted on the vertical flange 11'' of the U-shaped rail 11 and extends therefrom in a direction opposite to the horizontal flanges 11'. An endless belt 8 moves around the rollers 9, 9'.

Endless belt 8 is provided on its upper run with a pin 7 and on its lower run with a pin 12. The pin 7 is located near the rear end of the rail 11 when the drawer is pushed in and engages the slide 5 or is fixedly connected thereto.

The pin 12 is disposed next to the front slide 6 on the body 1 of the piece of furniture and is connected with slide 6. When the drawer 2 is pushed in, pin 12 is located near the front end of the rail 11. When the drawer is pulled out (FIG. 2), pin 12 is located almost in the center of the rail 11.

When the drawer 2 is pulled out of the body 1, i.e. moved in the direction of arrow A of FIG. 1, the pin 7 being anchored in the slide 5 draws the belt 8 also in the direction of arrow A. The belt 8 thereby remains anchored in the slide 6 by means of the pin 12, and, thus, the rail 11 is moved in the direction of arrow A and moves exactly half the distance of movement of the drawer 2.

The drawer 2 of the illustrated embodiment is made of plastic and has a front plate 13.

What is claimed is:

1. A pull-out guide assembly for use on each of opposite sides of a drawer in an article of furniture of the type wherein a drawer is slidably insertable into and removable from a furniture body, said pull-out guide assembly comprising:

separate plural first rail supports adapted to be fixed to a side of a drawer in spaced relationship with respect to each other along a direction of sliding movement of the drawer;

separate plural second rail supports adapted to be fixed to a side of a furniture body in spaced relationship with respect to each other along said direction;

a single rail directly supported by said plural first rail supports and by said plural second rail supports for relative sliding movement therebetween in said direction;

an endless belt mounted on said rail for movement in said direction; and connecting means for fixing said endless belt to the drawer and to the furniture body, such that movement of the drawer in said direction will pull said endless belt in said direction and cause said rail to slide with respect to said plural first and second rail supports.

2. An assembly as claimed in claim 1, wherein said connecting means comprises means for causing said rail to slide by a distance equal to half the distance of movement of the drawer.

3. An assembly as claimed in claim 1, wherein said connecting means comprise first means for directly fixing said endless belt to one of said first rail supports, and second means for directly fixing said endless belt to one of said second rail supports.

4. An assembly as claimed in claim 3, wherein said first means is attached to an upper run of said endless belt, and said second means is attached to a lower run of said endless belt.

5. An assembly as claimed in claim 1, wherein said plural first rail supports comprise one first rail support adapted to be fixed to the inner end of the side of the drawer and another first rail support adapted to be fixed to the drawer at a position midway of the depth thereof, and said plural second rail supports comprise one second rail support adapted to be fixed to the outer end of the side of the furniture body and another second rail support adapted to be fixed to the furniture body at a position midway of the depth thereof.

6. An assembly as claimed in claim 1, wherein said endless belt is mounted around a pair of rollers supported on opposite ends of said rail.

7. An assembly as claimed in claim 1, wherein said rail has a substantially U-shaped transverse cross-sectional configuration and includes a pair of vertically spaced horizontal flanged joined by a vertical flange.

8. An assembly as claimed in claim 7, wherein each of said first and second rail supports has therein a substantially L-shaped recess slidably receiving one of said horizontal flanges and a portion of said vertical flange.

9. An assembly as claimed in claim 7, further comprising first and second axles mounted in opposite ends of said rail and extending horizontally from said vertical flange in directions opposite from said horizontal flanges, and first and second rollers mounted about said first and second axles, respectively, said endless belt being mounted about said first and second rollers.

* * * * *